US007616175B2

(12) United States Patent
Kim

(10) Patent No.: US 7,616,175 B2
(45) Date of Patent: Nov. 10, 2009

(54) PLASMA DISPLAY DEVICE AND DRIVING APPARATUS THEREOF

(75) Inventor: Tae-Hyun Kim, Chunan-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 485 days.

(21) Appl. No.: 11/482,229

(22) Filed: Jul. 6, 2006

(65) Prior Publication Data

US 2007/0008308 A1 Jan. 11, 2007

(30) Foreign Application Priority Data

Jul. 6, 2005 (KR) ..... 10-2005-0060664

(51) Int. Cl.
*G09G 3/10* (2006.01)
*G09G 3/28* (2006.01)

(52) U.S. Cl. ..... 345/62; 315/169.4

(58) Field of Classification Search ..... 345/60–72, 345/204–214; 315/169.1, 169.4; 313/583–585, 313/631

See application file for complete search history.

(56) References Cited

U.S. PATENT DOCUMENTS 4,384,287 A * 5/1983 Sakuma ..... 345/60
4,866,349 A 9/1989 Weber et al.
5,081,400 A 1/1992 Weber et al.
6,563,272 B1 * 5/2003 Dufort ..... 315/169.4
7,242,372 B2 * 7/2007 Onozawa et al. ..... 345/60

FOREIGN PATENT DOCUMENTS

| | | | |
|---|---|---|---|
| CN | 1519803 | A | 8/2004 |
| CN | 1573863 | A | 2/2005 |
| EP | 1 376 523 | A2 | 1/2004 |
| JP | 2000-163012 | | 6/2000 |
| KR | 10-2005-0050847 | A | 6/2005 |
| WO | WO 01/35383 | A1 | 5/2001 |

* cited by examiner

*Primary Examiner*—David L Lewis
(74) *Attorney, Agent, or Firm*—Christie Parker & Hale LLP

(57) ABSTRACT

A plasma display device including first and second electrodes and a driving circuit alternately applying first and second voltages to the first and second electrodes. The driving circuit includes a power recovery unit, a sustain discharge voltage supply, and a gate voltage supply. The power recovery unit includes an inductor coupled between the first electrode and a capacitor, and increases/decreases the voltage of the first electrode by electrically coupling the inductor and the capacitor. The sustain discharge voltage supply includes a first transistor and a second transistor that couple the first electrode to a supply voltage and to ground. In case of damage to a circuit element, a current is established, through a Zener diode, coupled between the capacitor and the gate voltage supply, that disconnects the supply of voltage to gate drivers of the circuit transistors and stops the operation of the driving circuit.

12 Claims, 7 Drawing Sheets

PLASMA DISPLAY DEVICE AND DRIVING APPARATUS THEREOF

CROSS-REFERENCE TO RELATED APPLICATION

This application claims priority to and the benefit of Korean Patent Application No. 10-2005-0060664 filed in the Korean Intellectual Property Office on Jul. 6, 2005, the entire content of which is incorporated herein by reference.

BACKGROUND OF THE INVENTION

1. Field of the Invention

The present invention relates to a plasma display device and a driving apparatus of the plasma display device. More particularly, the present invention relates to a driving circuit of a plasma display device.

2. Description of the Related Art

A plasma display device is a display device using a plasma display panel (PDP) that uses plasma generated by gas discharge to display characters or images. Such a PDP includes, according to its size, more than several hundreds of thousands to millions of pixels (discharge cells) arranged in the form of a matrix.

The plasma display device is driven during frames of time that are divided into a plurality of subfields, which are time intervals that each have a corresponding weight value. In addition, each subfield has a reset period, an address period, and a sustain period. The reset period is for initializing the discharge cells so that the next addressing can be stably performed. The address period is for selecting turn-on/turn-off discharge cells (i.e., cells to be turned on or off). The sustain period is for causing a sustain discharge for displaying an image on the addressed discharged cells.

When reset, address, and sustain operations are performed in their respective periods, capacitance is created on the panel because a discharge space exists between each pair of electrodes, including a scan electrode and a sustain electrode, and the discharge space operates as a capacitive load (hereinafter, referred to as a "panel capacitor"). Hence, reactive power is needed in addition to power for sustain discharge, in order to apply a waveform alternately having a high-level voltage (e.g., 5V) and a low-level voltage (e.g., 0V) during the sustain period. Therefore, the plasma display device uses a power recovery circuit for recovering the reactive power and re-using it to apply a sustain discharge pulse to the scan electrode or the sustain electrode.

A power recovery circuit operates by establishing a resonance path between a panel capacitor and a power recovery capacitor. A path starting from the power recovery capacitor to the panel capacitor may be used to increase a voltage of the panel capacitor. The opposite path, from the panel capacitor to the power recovery capacitor may be used to decrease the voltage of the panel capacitor. In a conventional power recovery circuit, when a switch or diode that forms part of the resonance path is damaged and thus short-circuited, the power recovery capacitor may be over-discharged or over-charged. For example, when a switch provided on the path through which the voltage of the panel capacitor is increased is short-circuited, a switch coupled to a ground voltage (0V) is turned on and the power recovery capacitor is discharged when the panel capacitor receives 0V. When, the power recovery capacitor is discharged to 0V, a power recovery operation cannot be performed. On the other hand, when a switch provided on the path through which the voltage of the panel capacitor is decreased is short-circuited, a switch coupled to a Vs power source is turned on and the power recovery capacitor is charged when the panel capacitor receives the voltage of Vs. Then, the voltage of the power recovery capacitor becomes too high to achieve power recovery.

As a result, current stress on the switch coupled to the ground (0V) or to the power source of voltage Vs may be increased, resulting in over-heating of the power recovery circuit that would cause smoke to come out of the circuit. Consequently, circuit elements of driving circuits other than the power recovery circuit may be damaged.

SUMMARY OF THE INVENTION

The present invention provides a plasma display device and a driving apparatus of the plasma display device that prevent excessive heating of a power recovery circuit when elements of the circuit are damaged.

An exemplary plasma display device according to an embodiment of the present invention includes a plurality of first electrodes, a plurality of second electrodes, and a driving circuit for alternately supplying first and second voltages to the first and second electrodes, respectively. The driving circuit includes a power recovery unit, a sustain discharge voltage supply, a gate voltage supply, and a Zener diode. The power recovery unit includes at least one inductor having a first end electrically coupled to the first electrode and a capacitor for charging a third voltage. In addition, the power recovery unit increases or decreases the voltage of the first electrode by electrically coupling the at least one inductor and the capacitor. The sustain discharge voltage supply includes a first transistor that is electrically coupled between the first electrode and a first power source for supplying the first voltage to the first electrode and a second transistor electrically coupled between the first electrode and a second power source for supplying the second voltage. In addition, the sustain discharge voltage supply applies the second voltage to the first electrode after a voltage at the first electrode is decreased, and applies the first voltage to the first electrode after the voltage at the first electrode is increased. The gate voltage supply includes a fuse, and supplies a fourth voltage for generating a control signal to control a gate driver of the first or second transistor. The Zener diode is electrically coupled between the gate voltage supply and the capacitor. In a further embodiment, a breakdown voltage of the Zener diode is set between the third voltage and the first voltage, and the third voltage is set between the first voltage and the second voltage.

An exemplary driving apparatus according to an embodiment of the present invention alternately applies a first voltage and a second voltage to a plurality of first electrodes and a plurality of second electrodes of a plasma display, respectively, wherein the first voltage is lower than the second voltage. The driving apparatus includes a capacitor, at least one inductor, a first transistor, a second transistor, a third transistor, a fourth transistor, and a Zener diode. The capacitor is charged to a third voltage set between the first voltage and the second voltage. The at least one inductor is electrically coupled between the capacitor and the first electrode. The first transistor is electrically coupled between a first power source and the first electrode, the first power source supplying the first voltage. The second transistor is electrically coupled between a second power source and the first electrode, the second power source supplying the second voltage. The third transistor, when turned on, forms a current path flowing from the capacitor through the at least one inductor to the first electrode. The fourth transistor, when turned on, forms a current path flowing from the first electrode through the at least one inductor to the capacitor. The Zener diode is electrically coupled between a gate voltage supply and the capacitor. The gate voltage supply supplies a fourth voltage to a gate driver of at least one of the first to fourth transistors and to the capacitor.

Another embodiment presents a method for protecting a driving circuit of a plasma display device from damage resulting from circuit element malfunction. The plasma display device includes first electrodes and second electrodes. The driving circuit alternately supplies a first voltage and a second voltage to the first electrodes and alternately supplies the second voltage and the first voltage to the second electrodes. A capacitor is initially charged to a third voltage between the first voltage and the second voltage. A power recovery resonance path is established through an inductor coupled in series between one of the first electrodes and the capacitor. The first voltage is supplied to the first electrode after the power recovery resonance raises a voltage of the first electrode and the second voltage is supplied after the power recovery resonance lowers the voltage of the first electrode. A fourth voltage is supplied through a fuse for controlling the alternate supply of the first voltage and the second voltage to the first electrode. The capacitor is isolated from the fuse by a Zener diode. The fuse is disconnected and the alternate supply of the first voltage and the second voltage is stopped if a voltage charged in the capacitor exceeds the fourth voltage by a breakdown voltage of the Zener diode. The Zener diode is selected to have breakdown voltage set between the third voltage and the first voltage.

DETAILED DESCRIPTION OF THE EMBODIMENTS

Figure 1:
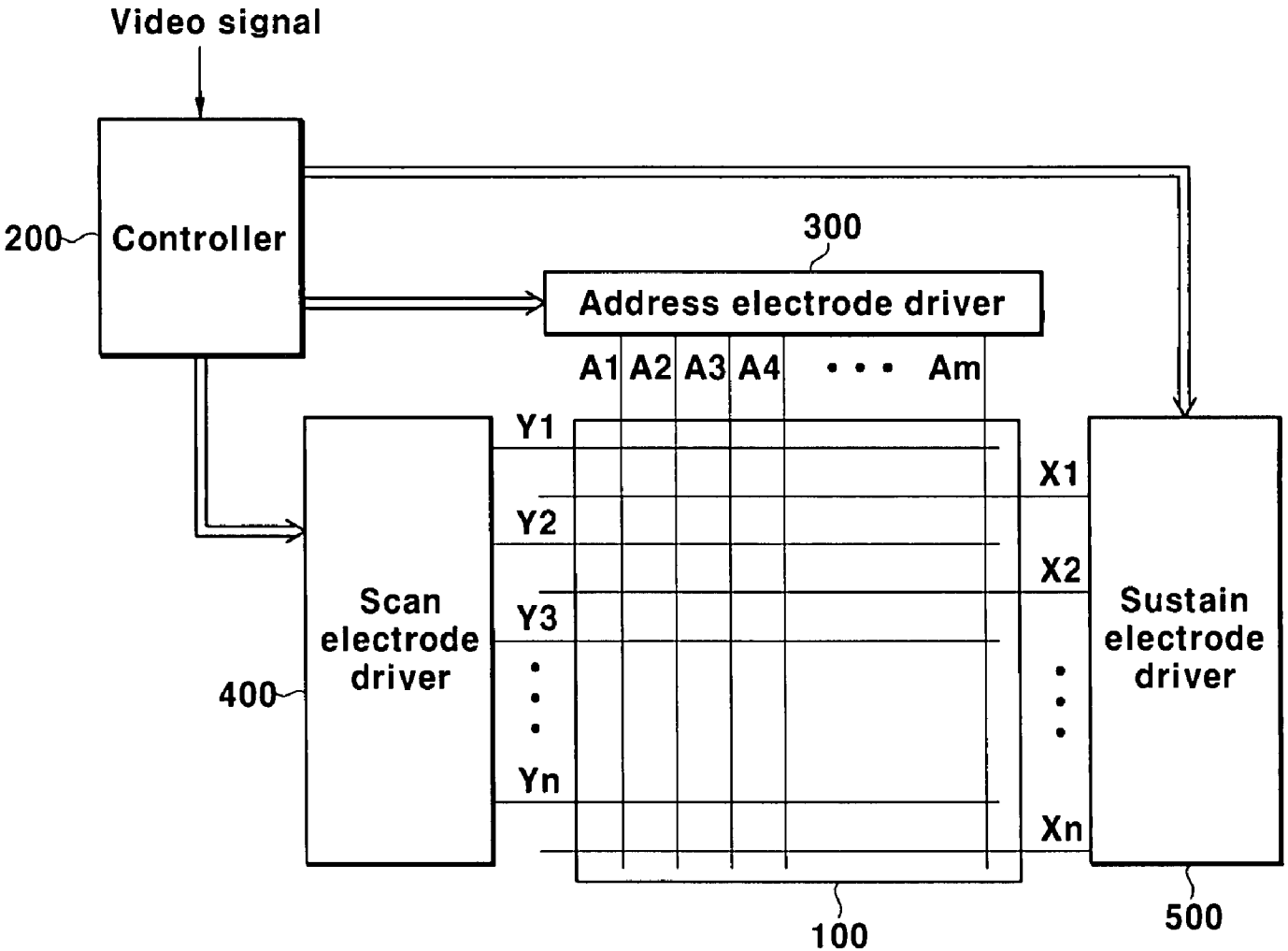
FIG. 1 shows a plasma display device according to an exemplary embodiment of the present invention.

FIG. 1 shows a plasma display device according to an exemplary embodiment of the present invention.

The plasma display device includes a plasma display panel (PDP) 100, a controller 200, an address electrode driver 300, a scan electrode driver 400, and a sustain electrode driver 500.

The PDP 100 includes a plurality of address electrodes A1-Am extended along a column direction, and a plurality of sustain electrodes X1-Xn and a plurality of scan electrodes Y1-Yn extended along a row direction in pairs. In general, the sustain electrodes X1-Xn are formed to respectively correspond to the scan electrodes Y1-Yn. In addition, the PDP 100 includes a substrate (not shown) where the sustain and scan electrodes X1-Xn and Y1-Yn are arranged, and another substrate (not shown) where the address electrodes A1-Am are arranged. The two substrates are placed facing each other with a discharge space therebetween so that the directions of the scan electrodes Y1-Yn and the address electrodes A1-Am may perpendicularly cross each other. The directions of the sustain electrodes X1-Xn and the address electrodes A1-Am may also perpendicularly cross each other. The discharge space at a crossing region of the address electrodes A1-Am with the sustain and scan electrodes X1-Xn and Y1-Yn forms a discharge cell. This structure of the PDP 100 is merely exemplary, and panels of other structures can be used in the present invention as well.

The controller 200 receives an external video signal, and outputs an address electrode driving control signal, a sustain electrode driving control signal, and a scan electrode driving control signal. In addition, the controller 200 drives the plasma display device by dividing one frame into a plurality of subfields. Each subfield includes a reset period, an address period, and a sustain period.

The address electrode driver 300 receives the address electrode driving control signal from the controller 200, and applies a display data signal for selecting a discharge cell to be discharged to each address electrode A.

The scan electrode driver 400 receives the scan electrode driving control signal from the controller 200, and applies a driving voltage to the scan electrode Y.

The sustain electrode driver 500 receives the sustain electrode driving control signal from the controller 200, and applies another driving voltage to the sustain electrode X.

Figure 2:
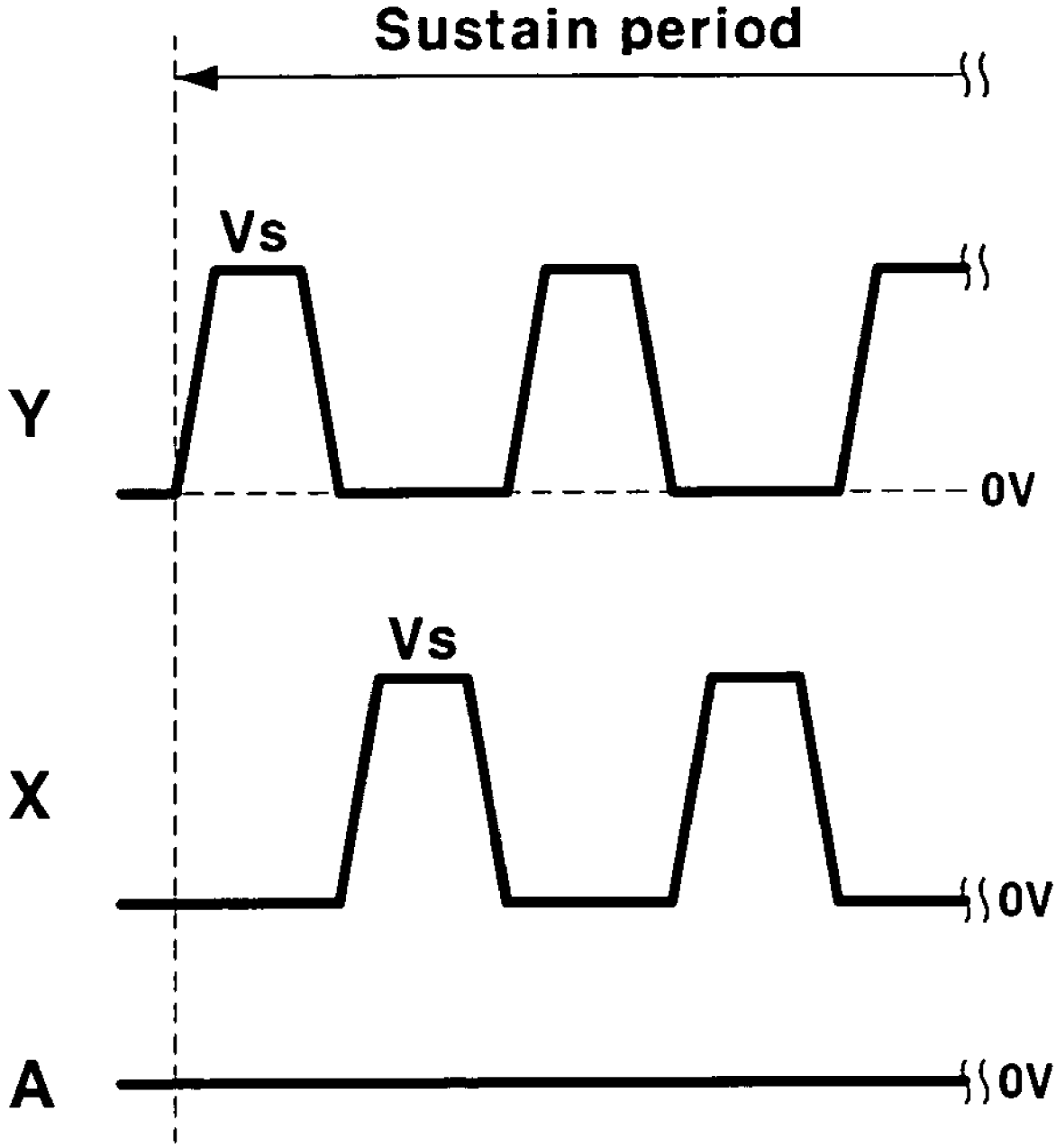
FIG. 2 shows driving waveforms of the plasma display device according to the exemplary embodiment of the present invention.

Referring to FIG. 2, driving waveforms of the plasma display device according to the exemplary embodiment of the present invention will now be described in more detail. For better understanding and ease of description, a driving waveform applied to one cell formed of a scan electrode (hereinafter, referred to as "Y electrode"), a sustain electrode (hereinafter, referred to as "X electrode"), and an address electrode (hereinafter, referred to as "A electrode") will now be described.

FIG. 2 shows a driving waveform during the sustain period. The sustain pulse alternately has a high-level voltage (voltage of Vs in FIG. 2) and a low-level voltage (0V in FIG. 2). Sustain pulses of inverse phases are applied to the Y and X electrodes during the sustain period. That is, the X electrode receives 0V while the Y electrode receives the voltage of Vs, and the Y electrode receives 0V while the X electrode receives the voltage of Vs. Then, a discharge is generated between the Y electrode and the X electrode due to the sustain pulses applied together with a wall voltage generated between the Y electrode and the X electrode by the address discharge during the address period that precedes the sustain period.

Subsequently, the process of alternately applying the sustain pulse to the Y electrode and the X electrode is repeated by a number of times corresponding to a weight value of the subfield.

A driving circuit for applying the sustain pulse during the sustain period will now be described in more detail with reference to FIG. 3, FIG. 4A, and FIG. 4B. These drawings illustrate a sustain discharge driving circuit of the scan electrode driver 400. Details of a sustain discharge driving circuit of the sustain electrode driver 500 is omitted from the drawings. An N-channel field effect transistor (FET) having a body diode is used as a switch in the circuits shown. However, another type of switch capable of performing the same or similar functions may be used instead of the N-channel FETs. A capacitive component formed by the X electrode and the Y electrode is denoted a panel capacitor Cp.

Figure 3:
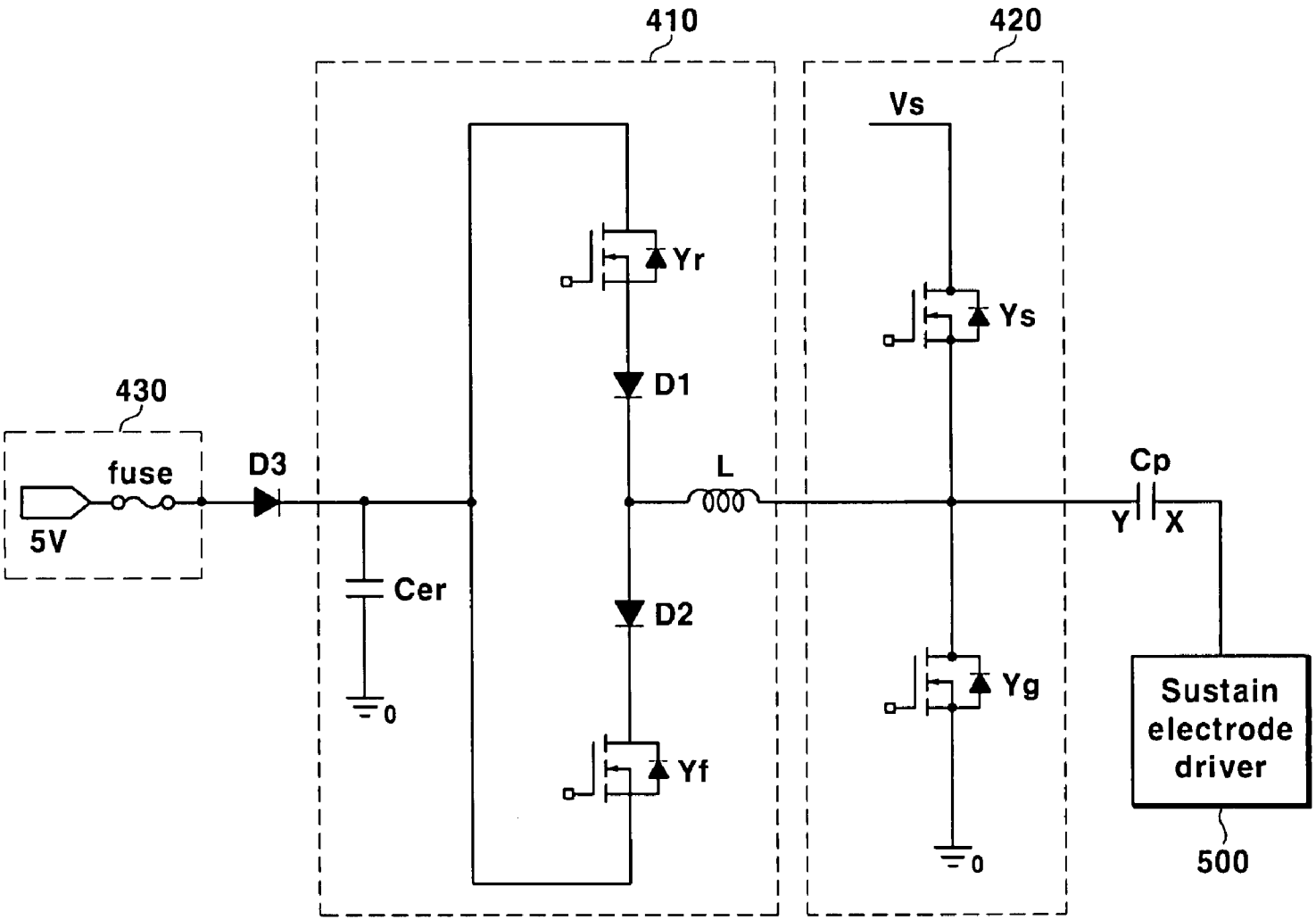
FIG. 3 shows a sustain discharge driving circuit according to a first exemplary embodiment of the present invention.

FIG. 3 shows a sustain discharge driving circuit according to a first exemplary embodiment of the present invention. The sustain discharge driving circuit of the scan electrode driver 400 includes a power recovery unit 410, a sustain discharge voltage supply 420, a gate voltage supply 430, and a diode D3.

The power recovery unit 410 includes transistors Yr and Yf, an inductor L, diodes D1 and D2, and a power recovery capacitor Cer. The power recovery capacitor Cer is coupled between a drain of the transistor Yr and a source of the transistor Yf. In addition, a Y electrode of the panel capacitor Cp is coupled with a first end of the inductor L. A second end of the inductor L is coupled between a source of the transistor Yr and a drain of the transistor Yf. The diode D1 sets an increasing path for increasing a voltage of the panel capacitor Cp in the case that the transistor Yr has a body diode. The diode D2 sets a decreasing path for decreasing a voltage of the Y electrode in the case that the transistor Yf has a body diode. The diodes D1 and D2 may be eliminated, respectively, when the transistor Yr and the transistor Yf do not have a body diode. With this configuration, the power recovery unit 410 increases or decreases the voltage of the Y electrode using a resonance generated by charging and discharging of the panel capacitor Cp.

In the power recovery unit 410, the order of connecting the inductor L, the diode D1, and the transistor Yr may be changed and the order of connecting the inductor L, the diode D2, and the transistor Yf may also be changed. For example, the inductor L may be coupled between a node of the transistors Yr and Yf and the power recovery capacitor Cer.

In FIG. 3, the inductor L is shown to be coupled to the node formed between the transistors Yr and Yf. However, inductors may be instead coupled to the increasing path formed by the transistor Yr and the decreasing path formed by the transistor Yf as parts of these paths.

The sustain discharge voltage supply 420 includes two transistors Ys and Yg. The transistor Ys is coupled between a power source for supplying a sustain discharge voltage Vs and the Y electrode of the panel capacitor Cp. The transistor Yg is coupled between a power source for supplying a ground voltage (0V in FIG. 3) and the Y electrode of the panel capacitor Cp. The two transistors Ys and Yg respectively supply the voltage Vs and the ground voltage to the Y electrode.

The gate voltage supply 430 includes a fuse, and supplies a driving voltage (e.g., 5V in FIG. 3) to gate drivers (not shown) of the transistors Ys and Yg. Therefore, while not shown, the gate drivers of the transistors Ys and Yg may receive their voltage from the gate voltage supply 430. As a result, these transistors may be turned on and off by the voltage being supplied from the gate voltage supply 430. The transistor or transistors controlled by the gate voltage supply 430 are capable of stopping the operation of the driving circuit when turned off. When the power recovery capacitor Cer is over-discharged due to damage to the circuit elements Yr, Yf, D1, or D2 of the power recovery unit 410, the fuse detects the over-discharge of the power recovery capacitor Cer and cuts off the power being supplied to the gate drivers of one or more of the transistors Ys and Yg. In an alternative embodiment, the gate voltage supply 430 may supply the driving voltage to the gate drivers of some or all of the transistors Yr, Yf, Ys, and Yg. In this alternative embodiment, the fuse would be able to stop the supply of power to any of the gate drivers of the transistors Yr, Yf, Ys, and Yg that are controlled by the gate voltage supply 430.

The diode D3 blocks a current path from the power recovery capacitor Cer, back through the fuse, to the power source of 5V when a voltage of the power recovery capacitor Cer is higher than a voltage supplied from the gate voltage supply 430. When the voltage of the power recovery capacitor Cer is lower than 5V, a current path is formed from the power source of 5V through the fuse to the power recovery capacitor Cer, and thus current flows to the power recovery capacitor Cer. However, the fuse is not designed to withstand the flow of current from the power source of 5V to the power recovery capacitor Cer and opens the circuit to disconnect the flow of this current. Once the fuse is disconnected, operation of the transistors and therefore the circuit is stopped.

Operation of a sustain discharge driving circuit during the sustain period according to the first embodiment of the present invention will now be described in more detail with reference to FIG. 4A. In the following description, the term inductance-capacitance (LC) resonance is used. It should be understood that the term does not necessarily refer to the infinite behavior of oscillation. In the following description, the term LC resonance is used to denote the curve or pattern of voltage behavior during voltage increase or a decrease.

Figure 4A:
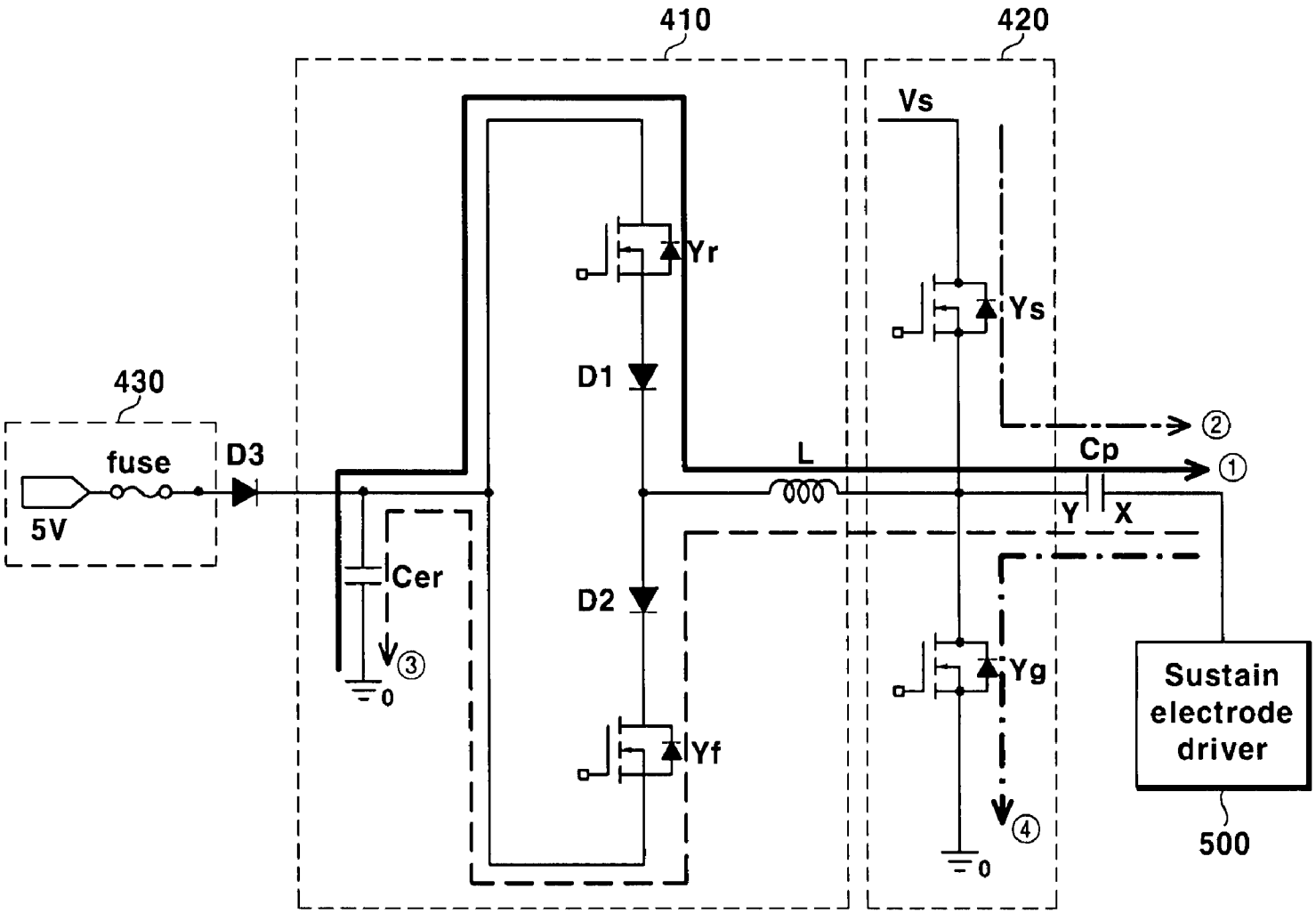
FIG. 4A shows a normal path of current flow of the driving circuit of FIG. 3.

FIG. 4A shows a normal path of current flow of the driving circuit of FIG. 3.

As the initial condition of the circuit, it may be assumed that the transistor Yg is turned on, the Y electrode of the panel capacitor Cp is coupled to ground (0V), and the power recovery capacitor Cer is pre-charged to a voltage Vs/2 equal to one half of the externally applied voltage Vs. It may also be assumed that all other transistors Yr, Yf, and Ys are off.

Next, the transistor Yr is turned on and the transistor Yg is turned off. Then, current path ① is formed from the ground terminal 0 through the power recovery capacitor Cer, the transistor Yr, and the inductor L, to the Y electrode of the panel capacitor Cp. An LC resonance circuit is formed by the current path ① and a voltage at the Y electrode of the panel capacitor Cp increases almost to the voltage of Vs according to the LC resonance characteristic curve.

Subsequently, the transistor Ys is turned on and the transistor Yr is turned off. Then, current path ② is formed from the power source of voltage Vs through the transistor Ys to the Y electrode of the panel capacitor Cp. The Y electrode of the panel capacitor Cp receives the voltage Vs through the current path ②.

Subsequently, the transistor Ys is turned off and the transistor Yf is turned on. Then, current path ③ is formed from the Y electrode of the panel capacitor Cp through the inductor L, the diode D2, the transistor Yf, and the power recovery capacitor Cer, to the ground terminal of 0V. The LC resonance circuit is formed by the current path ③ and the voltage charged at the Y electrode of the panel capacitor Cp is discharged such that the voltage of the Y electrode of the panel capacitor Cp is decreased to almost 0V according to the LC resonance characteristic curve.

Subsequently, the transistor Yg is turned on and the transistor Yf is turned off. Then, current path ④ is formed from the Y electrode of the panel capacitor Cp through the transistor Yg to the ground terminal of 0V. Thus the Y electrode of the panel capacitor Cp reaches 0V through the current path ④.

As described above, the sustain discharge driving circuit of the scan electrode driver 400, that is shown in FIG. 3, applies the sustain pulse to the Y electrode by the current repeatedly flowing through current paths ①, ②, ③ and ④ during normal operation of the circuit with undamaged circuit elements. A sustain discharge driving circuit for the sustain electrode driver 500 applies the sustain pulse to the X electrode by repeated current flow through similar current paths.

Figure 4B:
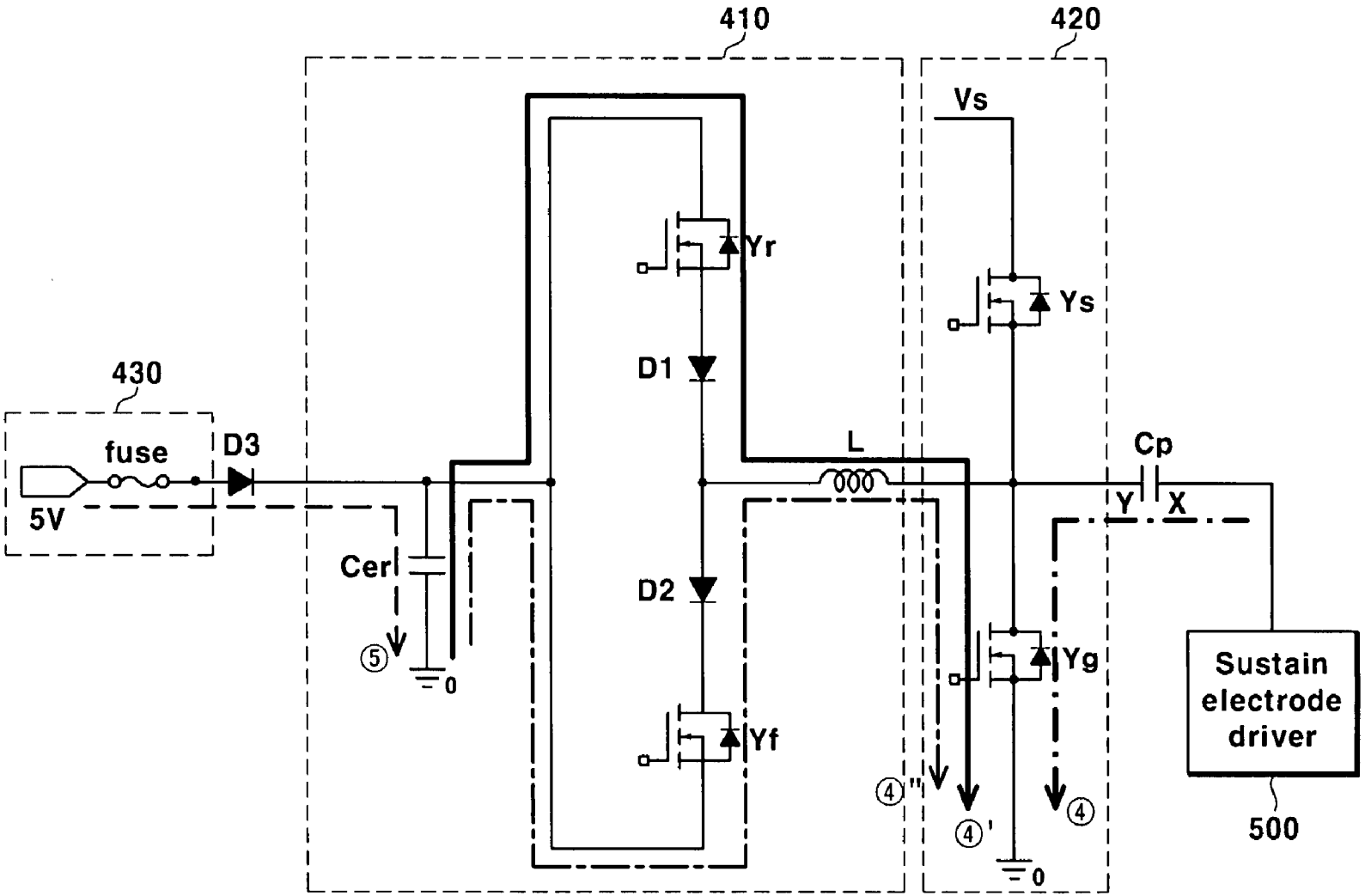
FIG. 4B shows a current flow of the driving circuit of FIG. 3 in the case that a power recovery circuit element is damaged.

FIG. 4B shows a current path of the driving circuit of FIG. 3 when a circuit element of the power recovery unit 410 is damaged.

Operation of the sustain discharge driving circuit according to the first embodiment of the present invention will now be described with reference to FIG. 4B. Assume that the circuit elements Yr or D2 in the power recovery unit 410 are damaged and thus the corresponding path through one of these elements is short-circuited.

When the transistor Yr of the power recovery unit 410 is damaged, the corresponding current path is short-circuited. The short-circuit of the transistor Yr may not have any influence on the current paths ①, ②, and ③, but when the Y electrode is connected through Yg to 0V, that is, when the current flows through the current path ④, another current path ④' is also formed. In the current path ④', current flows from the power recovery capacitor Cer through the short-circuited transistor Yr to the inductor L and finally passes through Yg to reach ground at 0V. When the current paths ①, ②, ③, ④ and ④' are repeated, the voltage of the capacitor Cer eventually reaches approximately 0V because the capacitor Cer is discharged through the current path ④'.

When the diode D2 of the power recovery unit 410 is damaged, the corresponding current path through this diode is short-circuited. The short-circuit of the diode D2 may not have any influence on the current paths ①, ②, and ③. However, when the transistor Yg is coupled to the 0V, that is, when the current flows through the current path ④, another current path ④" may also be formed through a body diode of the transistor Yf. In the current path ④", current flows from the power recovery capacitor Cer through the body diode of the transistor Yf to the short-circuited diode D2, to the inductor L and finally passes through Yg to reach ground at 0V. When the current paths ①, ②, ③, ④, and ④" are repeated, the voltage of the capacitor Cer eventually approaches 0V because the capacitor Cer is discharged through the current path ④".

Once the repeated discharge causes the voltage of the capacitor Cer to fall below the voltage of 5V supplied from the gate voltage supply 430, current path ⑤ is formed from the power source of 5V through the fuse to the diode D3. A current flows through the current path ⑤ and disconnects or opens the fuse. Accordingly, the supply of the power from the power source of 5V to the gate drivers of one or both of the transistors Ys and Yg is stopped. As a result, one or both of the transistors Ys and Yg are turned off and the operation of the sustain discharge driving circuit is stopped so that excessive heating of the transistors Ys and Yg that would cause smoke and damage to other circuit elements can be prevented.

As described above, the circuit of the first embodiment of the present invention may avoid the excessive heating of the transistors by preventing the capacitor Cer from being over-discharged through current paths ④' or ④". However, the over-charge of the capacitor Cer, that would also cause the smoke, cannot be avoided by the circuit of the first embodiment. The over-charge of the capacitor Cer, which causes the transistors to overheat and generate smoke, can be avoided by using the second exemplary embodiment of the present invention, that is described with reference to FIG. 5A and FIG. 5B.

Figure 5A:
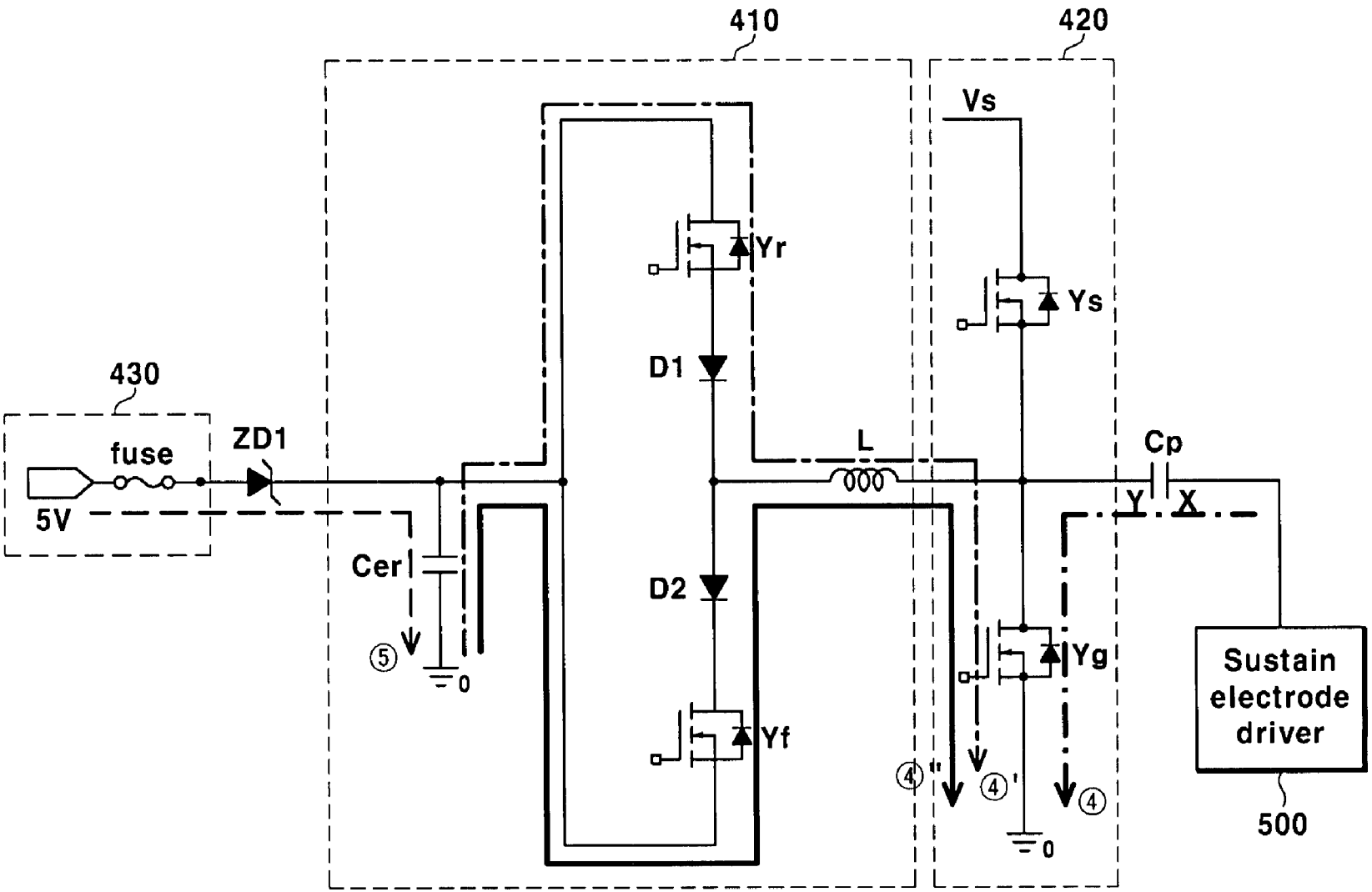
FIG. 5A shows a normal current flow path corresponding to an undamaged circuit in a sustain discharge driving circuit according to a second exemplary embodiment.
Figure 5B:
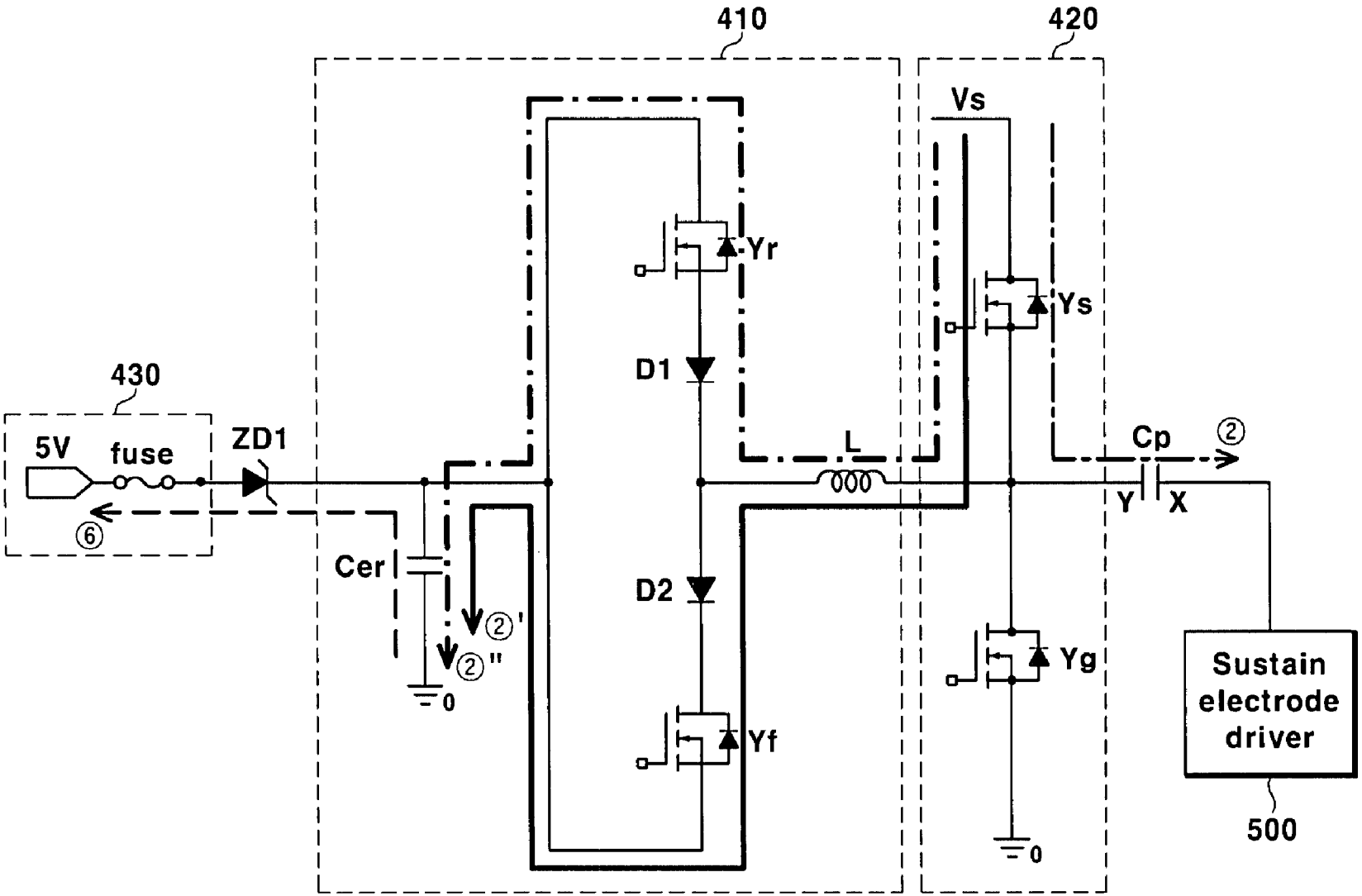
FIG. 5B shows a current flow path corresponding to a damaged circuit in the sustain discharge driving circuit according to the second exemplary embodiment.

FIG. 5A and FIG. 5B illustrate a sustain discharge driving circuit and a current path of the circuit according to a second exemplary embodiment of the present invention.

In the second exemplary embodiment, a Zener diode ZD1 is coupled between the gate voltage supply 430 and the power recovery unit 410 of the sustain discharge driving circuit, instead of the diode D3 coupled between the same two circuits in the sustain discharge driving circuit of the first exemplary embodiment of the present invention.

Through the Zener diode ZD1, a current path is formed either from a power source 5V to the power recovery capacitor Cer or from the power recovery capacitor Cer to the power source 5V when one or more of the circuit elements Yr, Yf, D1, or D2 of the power recovery unit 410 are damaged and the power recovery capacitor Cer is over-discharged or over-charged as a result of this damage. The Zener diode ZD1 is selected to have a breakdown voltage Vz set between the voltage of Vs/2 and the voltage of Vs. Therefore, if a voltage charged in the power recovery capacitor Cer exceeds the voltage of 5V by an amount between Vs/2 and Vs, then the Zener diode ZD1 may break down and current may flow from the capacitor Cer toward the power source 5V.

In more detail, as shown in FIG. 5A, the capacitor Cer is discharged when the transistor Yr or the diode D2 are damaged. As explained above, if the transistor Yr is damaged, the capacitor Cer discharges through the current path ④' and if the diode D2 is damaged, the capacitor Cer discharges through the current path ④". In these cases, the operation of the Zener diode ZD1 is the same as that of the diode D3 of FIG. 4B. As a result, current path ⑤ is formed from the power source of 5V to the capacitor Cer and the fuse is opened. Opening of the fuse cuts power to the gate drivers of the transistors and the operation of the circuit stops.

As shown in FIG. 5B, when the transistor Yf of the power recovery unit 410 is damaged, the current path through this transistor is short-circuited. The short-circuit of the transistor Yf may not have any influence on the current paths ①, ③, and ④. However, when the Y electrode is coupled to the voltage Vs and current flows through the current path ②, another current path ②' is also formed through the short-circuited transistor Yf. When the current paths ①, ②, ③, ④ and ②' are repeated, the voltage of the power recovery capacitor Cer exceeds Vs/2 or half the voltage of Vs because the power recovery capacitor Cer is over-charged through the repeating current paths ②'.

When the diode D1 of the power recovery unit 410 is damaged, the corresponding current path through D1 is short-circuited. The short-circuit of the diode D1 may not have any influence on the current paths ①, ③, and ④. However, when the Y electrode is coupled to the voltage Vs, that is, when current flows through the current path ②, an additional current path ②" is also formed through the damaged diode D1 and the body diode of the transistor Yr. When the current paths ①, ②, ③, ④ and ②" are repeated, the voltage of the power recovery capacitor Cer exceeds Vs/2 or half the voltage of Vs because the power recovery capacitor Cer is over-charged through the repeated current paths ②".

As explained above, the Zener diode ZD1 is selected to have a breakdown voltage Vz set between the voltage of Vs/2 and the voltage of Vs. When the voltage across the Zener diode ZD1 is above the breakdown voltage of this diode, that is, when the power recovery capacitor Cer is charged with a voltage that is higher than the breakdown voltage of the Zener diode ZD1 by more than 5V, a reverse current flows through the Zener diode ZD1. That is, current path ⑥ is formed from the capacitor Cer through the Zener diode ZD1 to the power source of 5V. When current flows through the current path ⑥, the fuse is opened (disconnected) and the supply of power from the power source of 5V to the transistors Yr, Yf, Ys, and Yg is stopped. As a result, the operation of the sustain discharge driving circuit is stopped, thereby preventing excessive heating that may cause smoke and avoiding damage to other circuit elements.

According to the above exemplary embodiments of the present invention, the supply of power by the gate voltage supply circuit to the gate drivers driving the transistors is stopped when the power recovery capacitor is over-charged or over-discharged due to the damage to the circuit elements of the power recovery unit. Stopping the supply of power to the gate drivers of the transistors, shuts off the circuit and prevents excessive heating that may cause smoke and avoiding damage to other circuit elements.

While this invention has been described in connection with certain exemplary embodiments, it is to be understood that the invention is not limited to the described embodiments, but, on the contrary, is intended to cover various modifications and equivalent arrangements included within the spirit and scope of the appended claims and their equivalents.

What is claimed is:

1. A plasma display device comprising:

a plasma display panel;

a plurality of first electrodes coupled to the plasma display panel;

a plurality of second electrodes coupled to the plasma display panel; and a driving circuit coupled to the first electrodes and the second electrodes, the driving circuit alternately supplying a first voltage and a second voltage to the first electrodes and alternately supplying the second voltage and the first voltage to the second electrodes, the driving circuit including:

a power recovery unit including at least one inductor having a first end electrically coupled to a first electrode and a capacitor being charged to a third voltage, the power recovery unit increasing or decreasing a voltage of the first electrode by electrically coupling the at least one inductor and the capacitor;

a sustain discharge voltage supply including a first transistor being electrically coupled between the first electrode and a first power source for supplying the first voltage and a second transistor being electrically coupled between the first electrode and a second power source for supplying the second voltage, supplying the second voltage to the first electrode after a voltage at the first electrode is decreased, the sustain discharge voltage supply supplying the first voltage to the first electrode after the voltage at the first electrode is increased by the power recovery unit;

a gate voltage supply including a fuse and supplying a fourth voltage for generating a control signal to control a gate driver of the first transistor or the second transistor; and a Zener diode electrically coupled between the gate voltage supply and the capacitor.

2. The plasma display device of claim 1, wherein a breakdown voltage of the Zener diode is set between the third voltage and the first voltage.

3. The plasma display device of claim 2, wherein the third voltage is between the first voltage and the second voltage.

4. The plasma display device of claim 2, wherein an anode of the Zener diode is coupled to the gate voltage supply and a cathode of the Zener diode is coupled to the capacitor.

5. The plasma display device of claim 1, wherein the power recovery unit comprises:

a third transistor electrically coupled between a second end of the at least one inductor and the capacitor; and a fourth transistor electrically coupled between the second end of the at least one inductor and the capacitor.

6. The plasma display device of claim 5, wherein a panel capacitor is formed between the first electrode and a second electrode, wherein the third transistor and the fourth transistor each have a body diode, and wherein the power recovery unit further includes:

a first diode coupled between the capacitor and the at least one inductor and determining a direction of current flow to charge the panel capacitor; and a second diode coupled between the capacitor and the inductor and determining a direction of current flow to discharge the panel capacitor.

7. A driving apparatus for alternately supplying a first voltage and a second voltage to a plurality of first electrodes and for alternately supplying the second voltage and the first voltage to a plurality of second electrodes of a plasma display device, the first voltage being lower than the second voltage, the driving apparatus comprising:

a capacitor for supplying a third voltage set between the first voltage and the second voltage, at least one inductor electrically coupled between the capacitor and a first electrode;

a first transistor electrically coupled between a first power source and the first electrode, the first power source supplying the first voltage;

a second transistor electrically coupled between a second power source and the first electrode, the second power source supplying the second voltage;

a third transistor forming a current path flowing from the capacitor through the at least one inductor to the first electrode;

a fourth transistor forming a current path flowing from the first electrode through the at least one inductor to the capacitor; and a Zener diode electrically coupled between a gate voltage supply and the capacitor, the gate voltage supply supplying a fourth voltage to a gate driver of at least one of the first transistor, the second transistor, the third transistor, or the fourth transistor and to the capacitor.

8. The driving apparatus of claim 7, wherein a breakdown voltage of the Zener diode is set between the first voltage and the third voltage.

9. The driving apparatus of claim 8, wherein an anode of the Zener diode is coupled to the gate voltage supply and a cathode of the Zener diode is coupled to the capacitor.

10. The driving apparatus of claim 8, wherein the gate voltage supply comprises a third power source supplying the fourth voltage, and a fuse electrically coupled to the gate driver of at least one of the first transistor, the second transistor, the third transistor, or the fourth transistor.

11. The driving apparatus of claim 7, wherein the third transistor and the fourth transistor each have a body diode, and wherein the driving apparatus further comprises:

a first diode electrically coupled between the capacitor and the at least one inductor on a current path including the third transistor; and a second diode electrically coupled between the capacitor and the at least one inductor on a current path including the fourth transistor.

12. A method for protecting a driving circuit of a plasma display device from damage resulting from circuit element malfunction, the plasma display device including first electrodes and second electrodes, the driving circuit alternately supplying a first voltage and a second voltage to the first electrodes and alternately supplying the second voltage and the first voltage to the second electrodes, the method comprising:

establishing a power recovery resonance path through an inductor coupled in series between a first electrode and a capacitor, the capacitor initially being charged to a third voltage between the first voltage and the second voltage;

alternately supplying the first voltage and the second voltage to the first electrode, the first voltage being supplied after the power recovery resonance raises a voltage of the first electrode, the second voltage being supplied after the power recovery resonance lowers the voltage of the first electrode;

supplying a fourth voltage through a fuse for controlling the alternately supplying the first voltage and the second voltage to the first electrode;

isolating the capacitor from the fuse by a Zener diode; and disconnecting the fuse and stopping the alternately supplying of the first voltage and the second voltage if a voltage charged in the capacitor exceeds the fourth voltage by a breakdown voltage of the Zener diode, wherein the breakdown voltage of the Zener diode is set between the third voltage and the first voltage.

* * * * *